US007237414B2

(12) United States Patent
Acquaviva et al.

(10) Patent No.: US 7,237,414 B2
(45) Date of Patent: Jul. 3, 2007

(54) COILER DRUM WITH RAISED SURFACES

(75) Inventors: Richard Acquaviva, Davenport, IA (US); Andrew P. Goodman, Bettendorf, IA (US)

(73) Assignee: IPSCO Steel, Inc., Lisle, IL (US)

( * ) Notice: Subject to any disclaimer, the term of this patent is extended or adjusted under 35 U.S.C. 154(b) by 45 days.

(21) Appl. No.: 10/968,932

(22) Filed: Oct. 21, 2004

(65) Prior Publication Data

US 2006/0086167 A1 Apr. 27, 2006

(51) Int. Cl.
*B21C 47/28* (2006.01)

(52) U.S. Cl. ..... 72/148; 72/229; 242/613

(58) Field of Classification Search ..... 72/148, 72/229, 147; 242/602, 602.1, 613

See application file for complete search history.

(56) References Cited

U.S. PATENT DOCUMENTS 2,865,575 A * 12/1958 Werner ..... 72/148

* cited by examiner

*Primary Examiner*—Lowell A. Larson
*Assistant Examiner*—Debra Wolfe
(74) *Attorney, Agent, or Firm*—Greenberg Traurig, LLP

(57) ABSTRACT

A coiler drum of a reversing rolling mill includes a work portion that engages a strip of metal being processed in the reversing rolling mill. The work portion includes an inner base surface and engaging strips that extend radially outward from the base surface. When the metal strip is engaged by the work portion, the metal strip does not contact the inner base surface, which has a surface area greater than 35 percent of the work surface. The engaging strips can be formed on the coiler drum by using weld overlays, inserts into slots, or by casting the engaging strips onto the coiler drum at the time the coiler drum is cast. The engaging strips may be laterally offset from one another and have a length less than 50 percent of the axial length of the work portion. The engaging strips may also be formed from a different material than the material of the work surface of the coiler drum.

35 Claims, 5 Drawing Sheets

COILER DRUM WITH RAISED SURFACES

FIELD OF THE INVENTION

The invention relates generally to the manufacturing of steel plate and, more specifically, to an improved coiler drum for use in a reversing rolling mill.

BACKGROUND OF THE INVENTION

One section of a conventional continuous casting line is illustrated in FIG. 1. Initially, molten steel is supplied to a continuous caster 10 that produces a cast steel strand 12. After the strand 12 exits the caster 10, the strand 12 is cut to length with a cutter 16 to produce a series of cast slabs 18 that are discharged to a rolling table 14. Subsequent to being severed from the strand 12, each slab 18 is transversely fed into a reheat furnace 15 using a transfer machine 20.

The reheat furnace 15 brings the slab 18 to a uniform temperature to facilitate rolling. Upon exiting the reheat furnace 15, the slab 18 is transferred to an upstream end of the rolling table 14. The slab 18 is then descaled in one or more descalers 24, 26, which apply a series of high-pressure waterjets/sprays onto the surface of the slab 18 to remove scale. The slab 18 is then processed by a reversing rolling mill 28. The rolling mill 28 is typically provided with upstream and downstream coiler furnaces 30, 32. Upon reaching a desired thickness in the rolling mill 28, the intermediate product 34 (also referred to as a strip) continues downstream to further processing (not shown). Downstream processing may include shearing the ends of the intermediate product 34, cutting the intermediate product 34 to length and/or coiling the intermediate product 34 into coils.

A Steckel mill is one of the various types of rolling mills, an example of which is illustrated in FIG. 2. This type of reversing rolling mill 28 typically passes the slab 18 through rollers 36, 38 several times to reduce the slab 18 to a strip (or intermediate product) 34 having a thinner thickness. The reversing rolling mill 28 also maintains the strip 34 at a relatively high temperature so as to produce a desired steel microstructure. Because the rolling reduction typically requires more than one or more passes through the rollers 36, 38, coiler furnaces 30, 32 are typically installed in-line with the reversing rolling mill 28 to maintain the temperature of the strip 34 between passes through the rollers 36, 38. One coiler furnace 30 is upstream of the rollers 36, 38 and a second coiler furnace 32 is downstream of the rollers 36, 38.

Each coiler furnace 30, 32 includes an internal rotatable generally-cylindrical drum 44, 46, generally known as a coiler drum. In operation, the leading edge, for a particular pass, of the strip 34 emerging from the rollers 36, 38 that requires further passes through the rollers 36, 38 is directed into the nearer coiler furnace 30, 32 and wound onto its respective coiler drum 44, 46. Subsequently, the strip 34 is unwound from the coiler drum 44, 46 as the strip 34 is fed back through the rollers 36, 38 for a further pass. If further rolling in the reversing rolling mill 28 is required, after the next pass through the rollers 36, 38, the strip 34 is wound onto the coiler drum 44, 46 of the coiler furnace 30, 32 on the other side of the rollers 36, 38.

FIG. 3 illustrates a conventional coiler drum 50, and the work surface 52 of the conventional coiler drum 50 is the portion of the coiler drum 50 that contacts the plate, strip, etc. of steel. With a conventional coiler drum 50, the work surface 52 is smooth or flat. However, a problem associated with a coiler drum 50 having a smooth work surface 52 is that the work surface 52 tends to accumulate detritus matter, such as scale and other debris, from the strip or refractory from the lining of the furnaces 30, 32. This unwanted material can be reintroduced onto the strip as a surface defect that can cause of portion of the strip to be undesirably scrapped, reworked or reclassified as a lower quality product.

One solution to this problem is to add channels 64 into the work surface 62 of the coiler drum 60, as illustrated in FIG. 4. These channels 64 are cut into the coiler drum 60 continuously from one end 66 of the coiler drum to the other end 68 and allow the unwanted material to accumulate within the channels 64. The strip, however, is still in contact with about 75–85% of the original surface 62 of the coiler drum 60, and it has been determined that notwithstanding the channels 64, the detritus material still accumulates on the work surface 62 of the coiler drum 60. Thus, there is a need to provide an improved coiler drum that reduces or eliminates that amount of detritus material that is reintroduced onto a strip.

SUMMARY OF THE INVENTION

This and other needs are met by the present invention, which in accord with one aspect includes a coiler drum having a work portion that engages a strip of metal being processed in a reversing rolling mill. The work portion includes an inner base surface and engaging strips that extend radially outward from the base surface. When the strip is engaged by the work portion, the strip does not contact the inner base surface, which has a surface area greater than 35 percent of the work surface. The engaging strips can be formed on the coiler drum by using weld overlays, inserts into slots, by casting the engaging strips onto the coiler drum at the time the coiler drum is cast, or by machining the inner base surface away from the work portion. The engaging strips may be laterally offset from one another and have a length less than 50 percent of the axial length of the work portion. The engaging strips may also be formed from a different material than the material of the work surface of the coiler drum. By reducing the amount of surface area of the coiler drum in contact with the strip, the amount of detritus material left on the coiler drum is reduced or eliminated, which reduces or eliminates the amount of detritus material reintroduced onto the strip.

Additional advantages of the present invention will become readily apparent to those skilled in the art from the following detailed description, wherein only an exemplary embodiment of the present invention is shown and described, simply by way of illustration of the best mode contemplated for carrying out the present invention. As will be realized, the present invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DETAILED DESCRIPTION OF THE PREFERRED EMBODIMENTS

Figure 1:
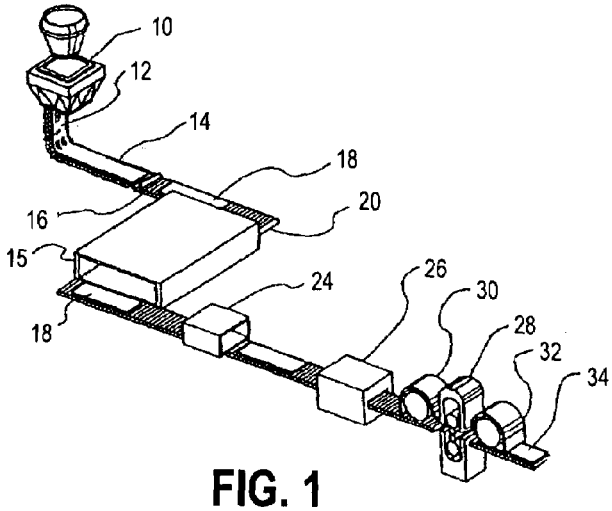
FIG. 1 PRIOR ART
FIG. 1 is a schematic perspective of a section of a conventional continuous casting, reheating, descaling and rolling line.
Figure 2:
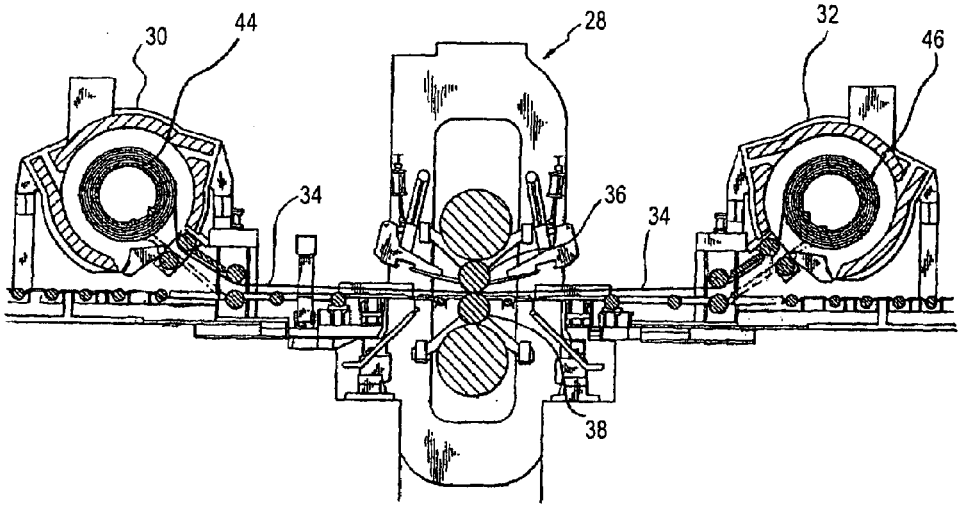
FIG. 2 PRIOR ART
FIG. 2 is a cross-sectional side view of a conventional reversing rolling mill.
Figure 3:
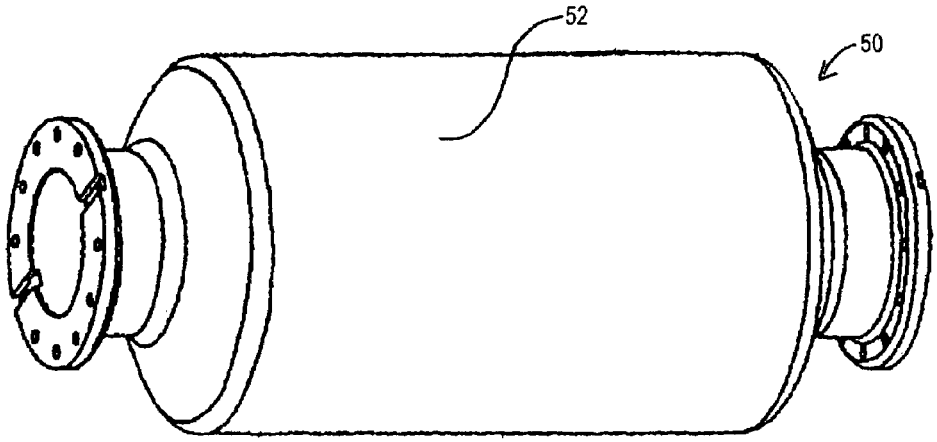
FIG. 3 PRIOR ART
FIG. 3 is a perspective view of a conventional coiler drum for use in a reversing rolling mill.
Figure 4:
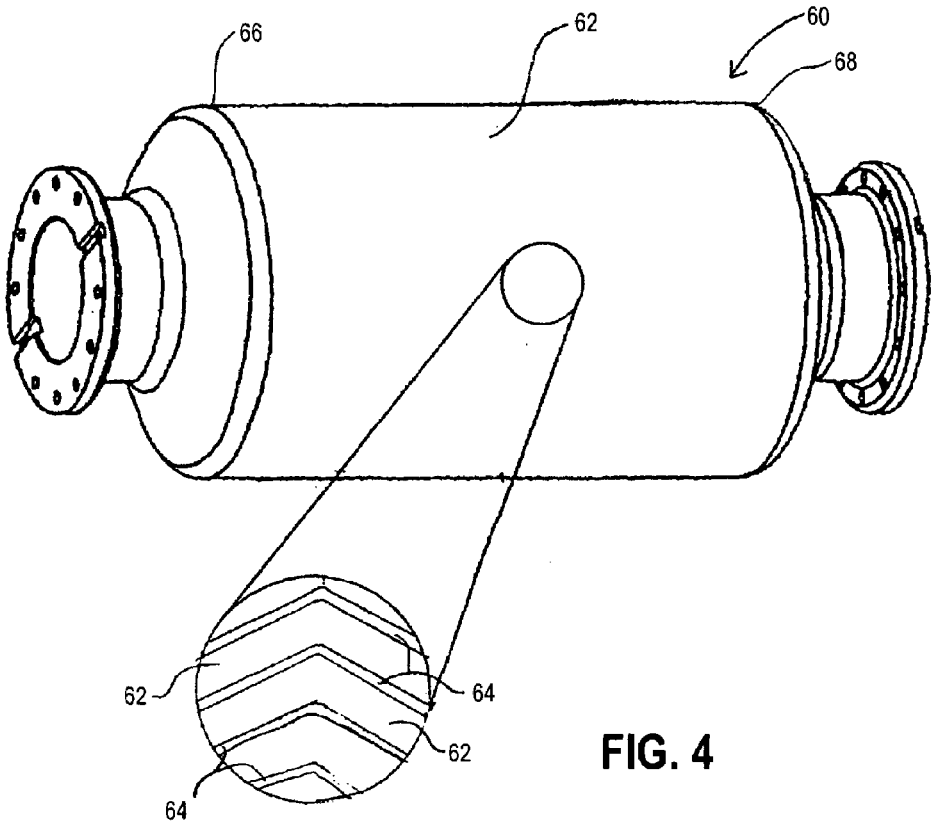
FIG. 4 is a perspective view of a conventional coiler drum having herring bone channels cut into the surface of the coiler drum.
Figure 5:
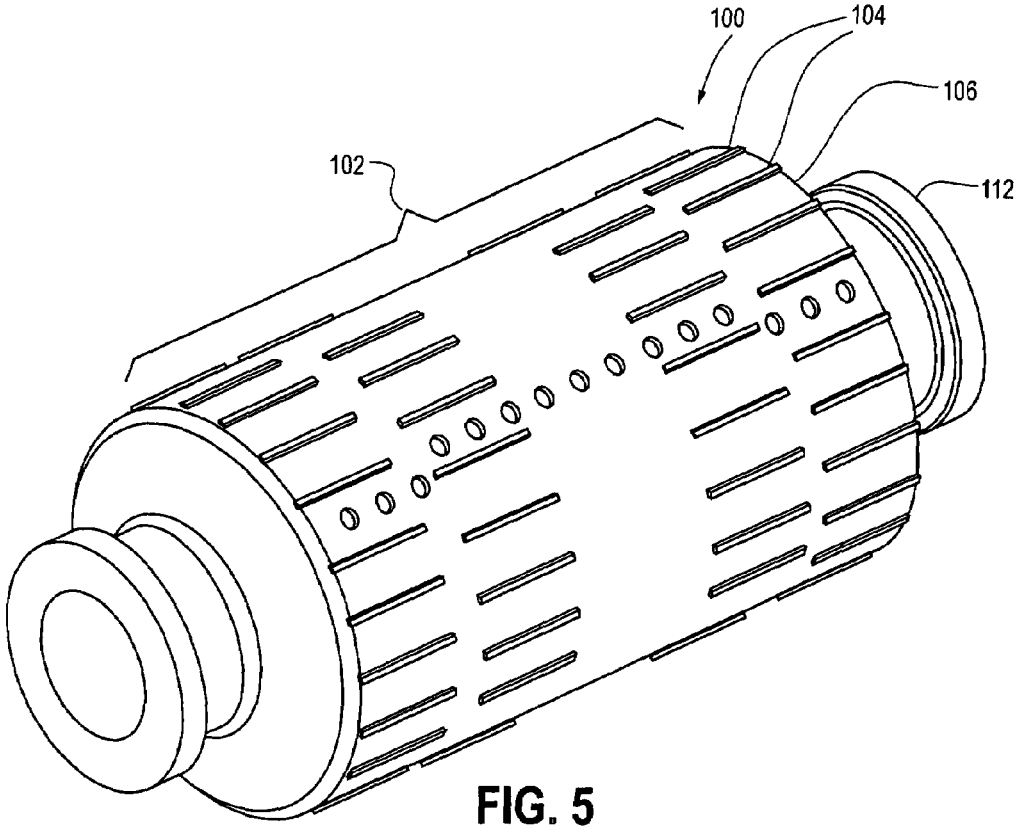
FIG. 5 is a perspective view of a coiler drum in accordance to an embodiment of the present invention.

A coiler drum 100 according to the present invention is illustrated in FIG. 5. The coiler drum 100 includes a work portion 102 for engaging a strip of metal being processed in a reversing rolling mill. The work portion 102 includes an inner base surface 106 and engaging strips 104 having raised surfaces extending radially outward from the base surface 106. The metal strip is engaged by the engaging strips 104 while the inner base surface 106 does not contact the metal strip.

In one aspect of the coiler drum 100, the inner base surface 106 covers greater than 35 percent of the total surface area of the work portion 102. In another aspect of the coiler drum 100, the inner base surface 106 covers greater than 75 percent of the total surface area of the work portion 102. In still another aspect of the coiler drum, the inner baser surface 106 covers between about 5 to about 20 percent of the total surface area of the work portion 102. By increasing the surface area of the inner base surface 106 relative to the surface area covered by the engaging strips 104, the frequency and amount of detritus material that is reintroduced onto the metal strip is reduced since a reduced surface area of the work portion 102 contacts the metal strip.

The orientation of the engaging strip 104 on the work portion 102 relative to coiler drum 100 can vary. For example, the engaging strips 104 may be formed in a herringbone pattern (not shown). In one aspect of the coiler drum 100, as shown in FIG. 5, the engaging strip 104 is substantially parallel to a central or longitudinal axis of the coiler drum 100. In so doing, the force exerted on the metal strip by the engaging strip 104 is substantially parallel to the direction of rotation of the coiler drum 100.

The length of the engaging strip 104 on the work portion 102 can also vary. For example, the engaging strip 104 may extend an entire length of the work portion 102 (not shown in FIG. 5). Alternatively the engaging strip 104 can extend only a portion of the axial length of the work portion 102, such as less than 50 percent. As illustrated in FIG. 5, the engaging strips 104 can be laterally offset or staggered across the work portion 102. The arc distance between engaging strips 104 is a function of the height of the engaging strips 104 above the inner base surface 106, and by staggering the engaging strips 104, the radial frequency of the engaging strips 104 can be maintained. At the same time the radial frequency of the engaging strips 104 is maintained, the total amount of engaging strips 104 (i.e., surface area covered by the engaging strips 104) can be reduced versus a non-staggered array of engaging strips 104.

Also, certain cross sections of the work portion 102 may not include any engaging strip 104. For example, stresses on the metal strip are greatest at the outside edges of the work portion 102 and are least at the middle portion of the work portion 102. To compensate for these different stresses, for example, the frequency of engaging strips 104 may be increased at the outer edges of the work portion 102 while the frequency of engaging strips 104 may decreased (or eliminated) at the middle portions of the work portion 102. In this manner, the total amount of the engaging strips 104 can be reduced and/or optimized.

Figure 6:
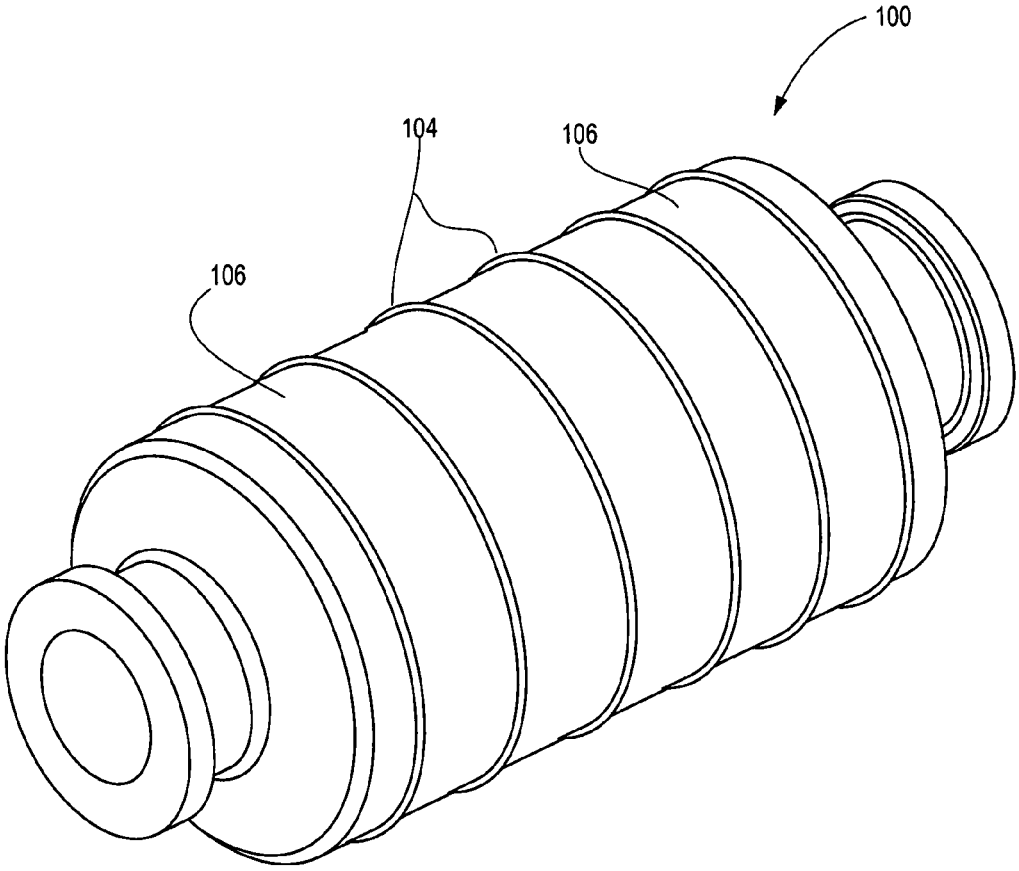
FIG. 6 is a perspective view of a coiler drum in accordance with another embodiment of the present invention.

In another embodiment of the coiler drum 100, illustrated in FIG. 6, the engaging strips 104 may be circumferentially oriented relative to the longitudinal axis of the coiler drum 100. Although illustrated as being continuous, the engaging strips 104 may also be circumferentially staggered. Furthermore, although the engaging strips 104 are illustrated as substantially perpendicular to the longitudinal axis of the coiler drum 100, the engaging strips 104 may be oriented relative to the longitudinal axis of the coiler drum 100 at an angle other than 90°, for example, in the shape of a helix.

The frequency of engaging strips 104 on the work portion 102 is not limited. Depending upon the particular application for which the coiler drum 100 is intended the frequency may increase or decrease. The frequency of the engaging strips 104 on the work portion 102 is a function of the height of the engaging strip 104 above the inner base surface 106, the width of the engaging strip 104, and the surface area of the work portion 102 to be covered by the engaging strips 104. The height of the engaging strip 104 sets a maximum distance between adjacent engaging strips 104 since the engaging strips 104 are preferably spaced apart to prevent the metal strip from touching the inner base surface 106 of the coiler drum 100. As the height of the engaging strip 104 increases, the maximum distance between adjacent engaging strips 104 also increases. Conversely, as the height of the engaging strip 104 is reduced, the maximum distance between adjacent engaging strips 104 decreases. For example, a 75 inch diameter coiler drum 100 with engaging strips 104 extending approximately 1 inch beyond the inner base surface 106, laterally-oriented engaging strips 104 (as shown in FIG. 5) can be placed every 22.5° without the strip of metal contacting the inner base surface 106.

The coiler drum 100 may also include a series of openings/holes 112 that extend from an inner portion of the coiler drum 100 to the outer surface of the work portion 102. These holes 112 advantageously allow scale or other detritus material trapped inside the inner portion of the caller drum 100 to fall out of the coiler drum 100. In one aspect of the coiler drum 100, the holes are positioned 180° opposite the mouth (best shown in FIG. 5) in the coiler drum 100 through which one end of the metal strip is inserted during the rolling of the metal strip. Positioning of the holes 112 may change in relation to the configuration of the mouth opening to allow scale or other detritus material inside the drum 100 to fall through the holes 112 while the drum 100 is rotating.

Figure 7:
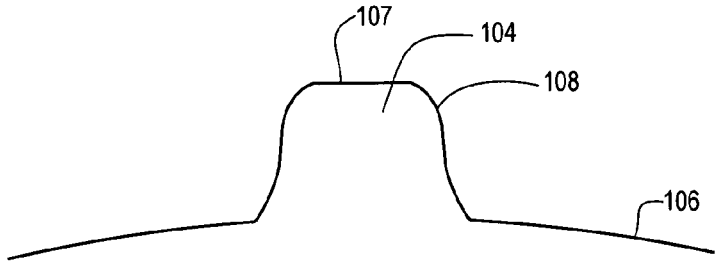
FIG. 7 is a cross-sectional view of a finished engaging strip on the coiler drum.

As illustrated in FIG. 7, the engaging strip 104 may include a generally flat upper surface 107 and chamfers/radii 108. The chamfers/radii 108 reduce any sharp edges on the engaging strips 104 and provide a better grip on the metal strip. The chamfers/radii 108 may extend to a substantially vertical surface on the engaging strip 104 relative to the inner base surface 106 (as shown) or the chamfers/radii 108 may completely extend to the inner base surface 106.

Figure 8A:
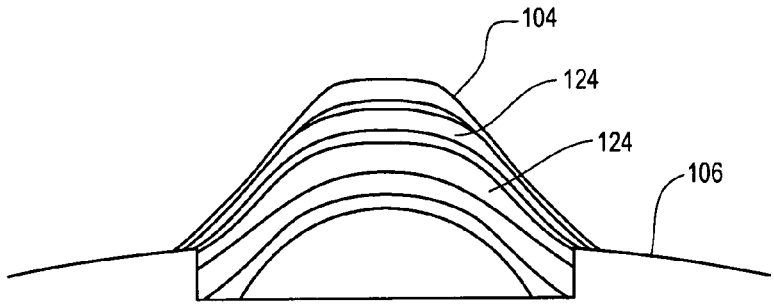
FIGS. 8A–8C are cross-sectional views of an engaging strip on the coiler drum formed respectively by welding, inserts, and casting.
Figure 8B:
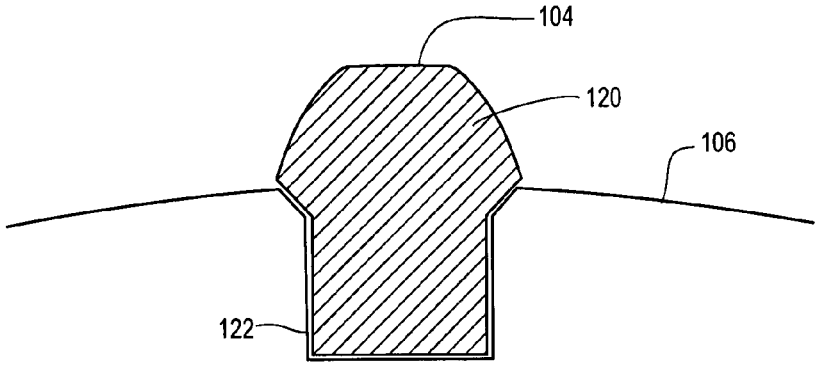
Figure 8C:
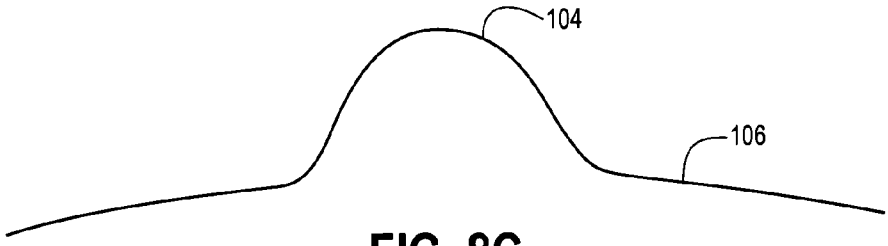

As illustrated in FIG. 8A–C, the manner is which the engaging strips 104 are formed on the work portion 102 of the coiler drum 100 is not limited. In FIG. 8A, for example, the engaging strip 104 can be formed by successively overlaying weld beads 124 on top of one another on the outer surface of the work portion 102. Once built up, the engaging strip 104 formed from weld beads 124 can be finished, for example by grinding or milling, to a desired shape.

By forming the engaging strip 104 in this manner, a conventional coiler drum having a non-contoured work portion 102 can be refurbished to include engaging strips 104 according to the invention. Also, the weld beads 124 may be formed from a different material than the material from which the remainder of the coiler drum 100 is formed. The material used to form the coiler drum 100 is intended to keep the coiler drum 100 structurally stable during the coiling process. Such a material, however, may not be the optimum material upon which to support the metal strip. By forming the engaging strip 104 by welding, a more optimal material can be used than the material used to form the remainder of the coiler drum 100.

In FIG. 8B, the engaging strip 104 is formed by introducing an insert 120 into a slot 122 formed in the work portion 102 of the coiler drum 100. The manner in which the slot 122 is formed in the work portion 102 is not limited. For example, the slot 122 may be formed by machining or grinding, or the slot 122 may be cast into the work portion 102 of the coiler drum 100 during the casting of the coiler drum 100 itself. The slot 122 has a depth less than the height of the insert 120 such that the top surface of insert 120 extends above the surface of the inner base surface 106. The manner is which the insert 120 is held within the slot 122 is also not limited. For example, the insert 120 may be welded into the slot 122, or the insert 120 may removably fastened into the slot 122 using, for example, bolts, which can allow the insert 120 to be replaced.

By forming the engaging strip 104 in this manner, a conventional coiler drum having a non-contoured work portion can be refurbished to include engaging strips 104 according to the invention by machining/grinding a slot 122 into the work portion 102 and positioning the insert 120 into the slot 122. Also, since the insert 120 may be formed separately from the coiler drum 100, the insert 120 may be formed from a different material than the material from which the remainder of the coiler drum 100 is formed. Furthermore, the insert 120 may be finished outside of the slot 122 in the coiler drum 100 to match the desired final shape of the engaging strip 104.

In FIG. 8C, the engaging strip 104 is formed by casting the engaging strip 104 onto the work portion 102 of the coiler drum at the time the coiler drum 100 is being cast. The cast engaging strip 104 may then be finished, for example by grinding or milling, to a final desired shape. In so doing, the number of steps needed to formed the engaging strip 104 can be reduced. The above described methods of forming the engaging strip 104 on the work portion 102 of the coiler drum 100 should be considered as illustrative, and not limiting, as the different types of methods used to formed the engaging strip 104.

The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without resorting to the details specifically set forth. In other instances, well known processing structures have not been described in detail, in order not to unnecessarily obscure the present invention.

Only an exemplary aspect of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. A coiler drum for use in a reversing rolling mill, comprising:

a work portion for engaging a strip of metal, the work portion having a work surface including an inner base surface, and engaging strips extending radially outward from the base surface, wherein the engaging strips have a length less than 50 percent of the axial length of the work portion.

2. The coiler drum according to claim 1, wherein each engaging strip is disposed within a slot formed in the inner base surface and each said engaging strip has a total height greater than a depth of the respective slot.

3. The coiler drum according to claim 1, wherein the engaging strips and the work portion are formed from a single cast molding.

4. The coiler drum according to claim 1, wherein the engaging strips are weld overlays formed on the work portion.

5. The coiler drum according to claim 1, wherein the engaging strips are substantially parallel to a central axis of the coiler drum.

6. The coiler drum according to claim 1, wherein adjacent engaging strips are laterally offset from one another.

7. The coiler drum according to claim 1, wherein the engaging strips are formed from a material different from which the inner base surface is formed.

8. A coiler drum for use in a reversing rolling mill, comprising:

a work portion for engaging a strip of metal, the work portion having a work surface including an inner base surface, and engaging strips extending radially outward from the base surface, wherein the inner base surface is greater than 35 percent of the work surface and wherein each engaging strip is disposed within respective slots formed in the inner base surface and each said engaging strip has a total height greater than a depth of the respective slot.

9. The coiler drum of claim 8 wherein the engaging strips are angled relative to a central axis of the coiler drum.

10. The coiler drum of claim 8 wherein the engaging strips are aligned substantially parallel to a central axis of the caller drum.

11. The coiler drum of claim 8 wherein the engaging strips are aligned substantially perpendicular to a central axis of the coiler drum.

12. The c:oiler drum of claim 8 wherein the engaging strips are formed from a material different from the material from which the inner base surface is formed.

13. A coiler drum for use in a reversing rolling mill, comprising:

a work portion for engaging a strip of metal, the work portion having a work surface including an inner base surface, and engaging strips extending radially outward from the base surface, wherein the inner base surface is greater than 35 percent of the work surface and wherein the engaging strips and the work portion are formed from a single cast molding.

14. The coiler drum of claim 13 wherein the engaging strips are angled relative to a central axis of the coiler drum.

15. The coiler drum of claim 13 wherein the engaging strips are aligned substantially parallel to a central axis of the coiler drum.

16. The coiler drum of claim 13 wherein the engaging strips are aligned substantially perpendicular to a central axis of the coiler drum.

17. The coiler drum of claim 13 wherein the engaging strips are laterally offset from one another.

18. A coiler drum for use in a reversing rolling mill, comprising:

a work portion for engaging a strip of metal, the work portion having a work surface including an inner base surface, and engaging strips extending radially outward from the base surface, wherein the inner base surface is greater than 35 percent of the work surface and wherein the engaging strips are weld overlays formed on the work portion.

19. The coiler drum of claim 18 wherein the engaging strips are angled relative to a central axis of the caller drum.

20. The coiler drum of claim 18 wherein the engaging strips are aligned substantially parallel to a central axis of the coiler drum.

21. The coiler drum of claim 18 wherein the engaging strips are aligned substantially perpendicular to a central axis of the coiler drum.

22. The coiler drum of claim 18 wherein the engaging strips are formed from a material different from the material from which the inner base surface is formed.

23. A coiler drum for use in a reversing rolling mill, comprising:

a work portion for engaging a strip of metal, the work portion having a work surface including an inner base surface, and engaging strips extending radially outward from the base surface, wherein the inner base surface is greater than 35 percent of the work surface and wherein a ratio of a height of the engaging strips and a distance between the strips is such that the metal strip is prevented from touching the inner base surface.

24. The coiler drum of claim 23 wherein the engaging strips are angled relative to a central axis of the coiler drum.

25. The coiler drum of claim 23 wherein the engaging strips are aligned substantially parallel to a central axis of the coiler drum.

26. The coiler drum of claim 23 wherein the engaging strips are aligned substantially perpendicular to a central axis of the coiler drum.

27. The coiler drum of claim 23 wherein the engaging strips are formed from a material different from the material from which the inner base surface is formed.

28. A coiler drum for use in a reversing rolling mill, comprising:

a work portion for engaging a strip of metal, the work portion having a work surface including an inner base surface, and engaging strips extending radially outward from the base surface, wherein the inner base surface is greater than 35 percent of the work surface and wherein at least one of the engaging strips is angled relative to a central axis of the coiler drum.

29. The coiler drum of claim 28 wherein the engaging strips are angled relative to the central axis of the coiler drum.

30. The coiler drum of claim 28 wherein at least one of the engaging strips is aligned substantially parallel to the central axis of the coiler drum.

31. The coiler drum of claim 28 wherein the engaging strips are aligned substantially perpendicular to the central axis of the coiler drum.

32. The coiler drum of claim 28 wherein the engaging strips are formed from a material different from the material from which the inner base surface is formed.

33. A method of manufacturing a coiler drum for use in a reversing rolling mill, comprising the steps of:

forming a work portion for engaging a strip of metal, the work portion having a work surface including an inner base surface, and engaging strips extending radially outward from the base surface, wherein the inner base surface is greater than 35 percent of the work surface; and forming a slot in the inner base surface for each engaging strip and inserting the engaging strips into a respective slot, and wherein the engaging strips each have a total height greater than a depth of the respective slot.

34. A method of manufacturing a coiler drum for use in a reversing rolling mill, comprising the steps of:

forming a work portion for engaging a strip of metal, the work portion having a work surface including an inner base surface, and engaging strips extending radially outward from the base surface, wherein the inner base surface is greater than 35 percent of the work surface, and wherein the engaging strips and the work portion are formed from a single cast molding.

35. A method of manufacturing a caller drum for use in a reversing rolling mill, comprising the steps of:

forming a work portion for engaging a strip of metal, the work portion having a work surface including an inner base surface, and engaging strips extending radially outward from the base surface, wherein the inner base surface is greater than 35 percent of the work surface, and wherein the engaging strips are weld overlays formed on the work portion.

* * * * *